US005866814A

United States Patent [19]

Jones et al.

[11] Patent Number: 5,866,814

[45] Date of Patent: Feb. 2, 1999

[54] PYROLYTIC OIL-PRODUCTIVITY INDEX METHOD FOR CHARACTERIZING RESERVOIR ROCK

[75] Inventors: Peter J. Jones; Mark H. Tobey, both of Dhahran, Saudi Arabia

[73] Assignee: Saudi Arabian Oil Company, Dhahran, Saudi Arabia

[21] Appl. No.: 941,607

[22] Filed: Sep. 30, 1997

[51] Int. Cl.[6] ..... E21B 49/00

[52] U.S. Cl. ..... 73/152.11

[58] Field of Search ..... 73/152.11, 863, 73/152.18, 153, 38, 152.12, 152.13; 324/376; 374/36; 422/78; 436/31, 55

[56] References Cited

U.S. PATENT DOCUMENTS 5,442,950 8/1995 Unalmiser et al. ..... 73/38

*Primary Examiner*—John Barlow
*Assistant Examiner*—Jonathan Spivey
*Attorney, Agent, or Firm*—Abelman, Frayne & Schwab

[57] ABSTRACT

Data from the pyrolytic analysis of rock samples obtained from drilling operations in an existing oil field are used to characterize the quality and condition of reservoir rock by comparison of the values of an index for the unknown reservoir rock samples with the value of the index for a known type and quality of petroleum reservoir rock sample, the index being denominated Pyrolytic Oil Productivity Index ("POPI") and defined by the expression:

$$ln(LV+TD+TC)\times(TD+TC)=POPI \quad (I),$$

where the terms of the equation are determined empirically and the resulting POPI values can be used to direct horizontal drilling operations in real time to optimize the position of the drilling bit in the reservoir.

23 Claims, 8 Drawing Sheets

PYROLYTIC OIL-PRODUCTIVITY INDEX METHOD FOR CHARACTERIZING RESERVOIR ROCK

FIELD OF THE INVENTION

This invention relates to the characterization of the quality and condition of reservoir rock during the extended exploration and further developmental drilling operations of a petroleum reservoir using data obtained from the pyrolysis of rock cuttings.

BACKGROUND OF THE INVENTION

Various methods have been employed for determining the porosity of petroleum-bearing reservoir rock. Such porosity measurements are used quantitatively in characterizing the reservoir rock for the purpose of determining hydrocarbon productivity and calculating reserves. One long-standing method is the direct analysis of cylindrical core samples that are taken during the drilling operation. Methods of analysis based on core samples have the advantage of being able to provide detailed and very accurate data of the reservoir quality at precisely known depths. The principal disadvantages of relying on core samples is that collecting the samples is both time-consuming and expensive, as is the processing of the core slabs to prepare samples for the one or more eventual analytical processes from which the data can be developed.

Down-hole "electric" or petrophysical logs are the most common means of assessing reservoir quality. The advantages of this technique are that the data is available immediately after the drilling of the well and the data can be obtained over the entire portion of the "open" well-bore. The disadvantages of this technique are that the data is not available until after the well is drilled, and this information cannot be used to assist in making drilling decisions. Measurement While Drilling ("MWD") or Logging While Drilling ("LWD") techniques partially overcome this deficiency; however, the cost for this service is very high and not all petrophysical tools can be utilized.

Another method for evaluating reservoir rock is based on the pyrolysis of rock cuttings that are carried to the surface during drilling operations by the drilling fluid, or "mud." Collection of rock cuttings associated with known depths is a well established procedure in petroleum drilling operations. Depth assignment to the cuttings is based on calculations which take into account drilling fluid circulation rate, hole geometry, fluid viscosity and weight, and other parameters. Collecting cuttings and assigning a depth to those cuttings are routine procedures during drilling operations.

The pyrolysis of reservoir rock and/or rock cuttings has been employed to determine the API gravity of oil and the composition of reservoir rock extracts. The pyrolytic method involves the heating of the sample in an inert atmosphere at an initial temperature of about 180° C. When the sample is inserted in the heated chamber, the light volatile hydrocarbons are removed and analyzed. The temperature is subsequently increased and heavier free oil is thermovaporized. Above approximately 400° C., hydrocarbons that have not been vaporized are thermally "cracked" to lighter hydrocarbons which are vaporized. The sample is heated to a maximum temperature of 600° C. in the inert atmosphere. The hydrocarbons released during these heating stages are quantified, as by a flame ionization detector ("FID"). If a complete analysis is required, the sample is contacted with a stream of oxygen or air at about 600° C. and the resulting $CO_2$ is analyzed by a thermal conduction detector ("TCD".)

Data plots of hydrocarbons released as a function of temperature can be produced on commercially available equipment. One such pyrolysis device and related analytical equipment is commercially available from the Institut Francais du Petrole through its distributor Vinci Technologies, (both of Rueil-Malmaison, France) under the trademark ROCK-EVAL. Another supplier of pyrolytic instrumentation is Humble Instruments & Services, Inc., of Humble, Tex.

As used in this specification and claims, the following terms have the meanings indicated:

HC means hydrocarbons.

ln means natural logarithm.

LV is the weight in milligrams of HC released per gram of rock at the static temperature condition of 180° C. (when the crucible is inserted into the pyrolytic chamber) prior to the temperature-programmed pyrolysis of the sample.

TD is the weight in milligrams of HC released per gram of rock at a temperature between 180° C. and $T_{min}$° C.

TC is the weight in mg of HC released per gram of rock at a temperature between $T_{min}$° C. and 600° C.

LV+TD+TC represents total HC vaporizing between 180°–600° C. A low total HC indicates rock of lower porosity or effective porosity. A low value can also indicate zones of water and/or gas.

$POPI_o$ is the value of the pyrolytic oil productivity index as calculated for a representative sample of crude oil of the type which is expected to be found in good quality reservoir rock in the region of the drilling and chosen as a standard.

$T_{min}$ (°C.) is the temperature at which HC volatization is at a minimum between the temperature of maximum HC volatization for TD and TC and is empirically determined for each sample. Alternatively, a temperature of 400° C. can be used for samples where there is no discernable minimum between TD and TC. The latter sample types generally have very low total HC yields.

Phi is the average porosity of the rock.

Sxo is the saturation of drilling mud filtrate and represents the amount of HC displaced by the filtrate, and therefore, movable HC.

Phi*Sxo vs depth plot—the area below the curve represents the proportion of porosity which contains movable HC.

Phi vs depth plot—the area between the Phi curve and the Phi*Sxo curve represents immovable HC, or tar.

Gamma—the naturally occurring gamma rays that are given off by various lithologies while measuring directly in the well bore by the prior art petrophysical tools and are reported in standard API (American Petroleum Institute) units.

Caliper—the measured diameter of the well bore taken at the time of running petrophysical logs.

Density porosity—the porosity calculated by prior art methods from the petrophysical bulk density tools using an assumed fluid and grain density.

Neutron porosity—the porosity measured by prior art methods from petrophysical neutron tools.

Deep resistivity—the resistivity measured by deep invasion (long spacing between source and receiver), lateral log or induction petrophysical tools which is used as a measurement of undisturbed formation resistivity.

Medium resistivity—the resistivity measured by medium invasion (medium spacing between source and receiver), lateral log or induction petrophysical tools which is used as a measurement of resistivity of the formation that has been flushed by mud filtrate from the drilling fluid.

Shallow resistivity—the resistivity measured by shallow invasion (short spacing between source and receiver), lateral log or induction petrophysical analytic techniques which is used as a measurement of the resistivity of the mud filtrate from the mud cake that forms on the interior of the well bore during drilling operations.

Neutron-density cross-plot porosity (N-D Phi)—the porosity determined from a common prior art method which compensates for the effects of lithologic and fluid changes that lead to inaccuracies in employing either density or neutron porosity measurements by themselves.

Core plug permeability—the permeability measured by prior art methods from cylindrical rock samples that are cut from cores taken from the drilling process that is reported in units of millidarcys (md).

In a typical pyrolytic data plot of oil-productive reservoir rock prepared in accordance with prior art methods, the first peak, which is detected when the sample is first placed in the pyrolysis oven at the initial temperature of 180° C. and before the temperature program begins, is from the volatile components still present in the sample after sample preparation. These will be referred to as the Light Volatile Hydrocarbons, reported in milligram per gram rock sample, and represented by LV or LVHC. As the temperature program proceeds, a plot of temperature vs. released hydrocarbons detected results in a curve that first increases from the starting point at 180° C., then gradually falls off to a minimum value in the vicinity of 400° C.±20° C. where thermocracking of the heavier petroleum components begins to occur. As thermocracking proceeds with increasing temperature, released hydrocarbons detected increase to a maximum and then fall off as the rock cutting sample reaches a maximum temperature of about 600° C. For any given sample, the minimum temperature point between the two peaks is referred to as $T_{min}$. The area under the first peak between 180° C. (i.e., the starting point) and $T_{min}$ represents the total weight of hydrocarbons released in that temperature range, generally reported as milligrams per gram ("mg/g") of rock sample, and are referred to as the Thermally Distilled Hydrocarbons and represented as TD or TDHC. The area under the second peak between $T_{min}$ and 600° C. represents the total weight of hydrocarbons that are first thermally cracked before thermal distillation from the substrate and detection and are reported in mg/g of rock sample, and are referred to as the Thermally Cracked Hydrocarbons (TC or TCHC). Various techniques for analyzing the pyrolysis data represented by LVHC, TDHC and TCHC have been practiced in the art.

In the pyrolytic analysis process, small samples (e.g., ≦100 mg) of powdered rock are placed in a steel crucible. The crucible is placed in a furnace and the sample is heated in a stream of helium gas to an initial temperature of 180° C. After heating at 180° C. for about three minutes, the temperature is increased. The rate of increase in the temperature is about 25° C./min. or less, and preferably about 10° C./min, and progresses from 180° C. to about 600° C.

The helium gas carries hydrocarbon products released from the rock sample in the furnace to a detector which is sensitive to organic compounds. During the process, three types of events occur:

1) Hydrocarbons that can be volatilized at or below 180° C. are desorbed and detected while the temperature is held constant during the first 3 minutes of the procedure. These are called light volatile hydrocarbons (LVHC or LV).
2) At temperatures between 180° C. and about 400° C., thermal desorption of solvent extractable bitumen, or the light oil fraction, occurs. These are called thermally distilled hydrocarbons or "distillables" (TDHC or TD).
3) At temperatures above about 400° C., pyrolysis (cracking) of heavier hydrocarbons, or asphaltenes, occurs. The materials that thermally crack are called thermally cracked hydrocarbons or "pyrolyzables" (TCHC or TC).

These events give rise to three 'peaks' on the initial instrument output (referred to as a pyrogram). The peak for the static 180° C. temperature is a standard output parameter of either the Vinci or Humble instruments. It is referred to as either $S_1$ or volatile total petroleum hydrocarbons (VTPH), respectively. In the present invention, the value will be referred to as LV, as described above. Data generated from the temperature programmed pyrolysis portion of the procedure is reprocessed manually by the operator to determine the quantity of hydrocarbons in milligrams per gram of sample above and below $T_{min}$. This reprocessing is a trivial exercise for an experienced operator and can be accomplished routinely with either the Vinci or Humble instruments. The first peak above 180° C. represents the amount of thermally distillable hydrocarbons in the sample and is referred to as TD, the second peak above 180° represents the amount of pyrolyzables or thermally "cracked" hydrocarbons in the sample and is referred to as TC. In the case of lighter hydrocarbons or the analysis of oil samples directly for calibration, $T_{min}$ may not be discernable. In this case, if the sample analysis is repeatable at 400° C., the values of LV, TD, and TC employed in the method of the present invention are with respect to the specific temperature ranges defined above.

In other pyrolytic methods known to the prior art, measurement of released hydrocarbons was undertaken in the range up to 180° C. and identified as $S_1$, or volatile total petroleum hydrocarbons (vTPH) while $S_2$ or pyrolyzable total petroleum hydrocarbon (pTPH) was the value associated with hydrocarbons released between 180° C. and 600° C.

The prior art methods for collecting and analyzing the data obtained by pyrolytic analysis have been found to be of limited value in making reliable determinations of the quality and condition of reservoir rock, particularly in regions of tar mats and occlusions.

It is often the case that tar mats are found between productive reservoir regions. Tar mats can be defined as high concentrations of bitumens enriched by asphaltenes. They form more or less continuous layers in the porous medium of the reservoir rock that can range from several feet to tens of feet in thickness and constitute barriers impermeable to the flow of crude oil.

Delays in obtaining information on the character and condition of reservoir rock can be especially costly when the drilling operation is being conducted "horizontally." As used hereafter in reference to well drilling operations, the term "horizontal" means wells bored outwardly from the nominally vertical well shaft or bore leading from the earth's surface. These horizontal wells are drilled for the purpose of exploring areas horizontally displaced from the vertical well shaft. Horizontal drilling is typically undertaken in an effort to increase the total footage of productive reservoir rock encountered by the well bore. Because of the potential for rapid changes in conditions from one area to another in the horizontal plane, it is desirable to characterize the reservoir rock as quickly as possible. Discontinuing drilling operations while awaiting analytical data can incur significant costs, and the costs of utilizing the MWD or LWD analytical techniques described above are also very high.

As will be apparent to one familiar with the costs involved, it would be particularly advantageous to be able to identify the presence of tar mats on something approaching a "real time" basis as the horizontal drilling operation proceeds. This information would permit the direction of the drill to be changed "on the fly" once the tar mat was detected.

It is therefore an object of this invention to provide an improved method, that is timely and cost efficient, for determining the quality and condition of reservoir rock during petroleum exploration drilling operations.

It is another object of the invention to provide a method for utilizing pyrolytic analysis data to differentiate between good and excellent quality reservoir rock.

It is also an object of the invention to provide an improved method of employing data from the pyrolytic analysis of rock cuttings for determining the character and quality of reservoir rock, including the existence of zones of low porosity rock and rock of low effective porosity.

It is a further object of the invention to provide a method from which information concerning the quality and condition of the reservoir rock can be quickly derived in the field and at the drilling site so that any changes in the direction of drilling can be made "on the fly" to maintain the position of the drill bit in the stratigraphic region of optimum production.

It is yet another object of the invention to provide a method by which the presence of tar mat in the vicinity of the drilling bit can be quickly and reliably determined by analysis of rock cuttings.

It is also an object of this invention to provide a reliable method for determining when the well bore has proceeded from oil-productive reservoir either structurally higher into a gas cap, if present, or downward below an oil-water contact.

SUMMARY OF THE INVENTION

The above objects and others are met by the method of the invention.

What we have found is data obtained from the pyrolytic analysis of rock cutting samples can be utilized to provide an extremely reliable indicator of the character and quality of reservoir rock. Data points have been identified using the method of the invention for delineating and distinguishing between (a) oil productive, (b) marginally oil productive/marginal reservoir rock and (c) tar-occluded/non-reservoir rock. These data points can be determined in real time during drilling operations, so that changes in the direction of horizontal boring can be made.

The method of the invention provides data that are at least as reliable as conventional log data based on time-consuming and relatively complex analytical techniques that are only available long after the directional drilling decisions have been made.

In the practice of the method of the invention the following expression is used to provide one or more data points:

$$ln(LV+TD+TC)\times(TD\div TC)=POPI \quad (I)$$

In the above expression, the term "ln(LV+TD+TC)" means the natural logarithm of the value and the term "POPI" is used as shorthand for Pyrolytic Oil Productivity Index. The term POPI is also used more broadly hereinafter as a reference to the method of the invention.

In one preferred embodiment of the invention, the method includes the sampling of reservoir rock cuttings from known depths and locations in an active drilling site, processing the cuttings to prepare the cuttings for analysis, obtaining data from the pyrolysis of each of these specially processed reservoir rock cutting samples, and producing a tabular or graphic representation or plot based on the sampling and pyrolytic data which representation indicates the character and quality of the reservoir rock with respect to its oil production potential.

More specifically, the method is directed to the steps of:

(a) collecting the rock cuttings from a first location;

(b) preparing the rock cuttings for pyrolytic analysis;

(c) subjecting the prepared rock cuttings to pyrolytic analysis to provide data corresponding to LV, TD and TC;

(d) graphically plotting the relationship expressed by the value of:
ln(LV+TD+TC)×(TD÷TC) versus measured depth for said first location;

(e) repeating said steps (a)–(d) above for rock cuttings obtained from a plurality of different locations displaced known distances from said first location to provide a graphic plot; and (f) identifying the vertical intervals on said graphic plot corresponding to POPI values as determined by formula (I) of:
(i) 0 to about ½$POPI_o$ as tar-occluded and/or non-reservoir rock,
(ii) from ½$POPI_o$ to $POPI_o$ as marginal oil-producing reservoir rock and
(iii) above about $POPI_o$ as oil-producing reservoir rock.

If the depth is plotted horizontally, the POPI values corresponding to 0, ½$POPI_o$ and $POPI_o$ are entered as horizontal lines. The same data can be entered in tabular form. Graphic and tabular forms resulting from the practice of the method of the invention can be prepared manually or by a typical spreadsheet or graphical software on a suitably programmed general purpose computer.

The value of $POPI_o$ refers to the POPI value that has been determined using formula I for typical good quality reservoir rock containing oil of known composition from the region in which the drilling is proceeding. The composition or type of the oil in the region will have been determined previously and represents historical information from the original exploration of the region, e.g., via vertical drilling operations. Similarly, the characteristics of good quality reservoir rock will likewise have been determined relative to the region in which the horizontal drilling is planned or is proceeding. Thus, the value of $POPI_o$ as a standard for use in practicing the method of the invention can be determined before the horizontal drilling is commenced.

Oil composition is known to vary significantly in its specific gravity (gm/cc) or API gravity. This variance is due to differences in the relative quantities of the light molecular weight (typically hydrocarbons with less than 15 carbon atoms in each molecule), medium molecular weight (typically hydrocarbons with greater than 15 and less than 40 carbon atoms in each molecule), and high molecular weight components (typically hydrocarbons with greater than 40 carbon atoms and non-hydrocarbons with molecular weights between 500 and 1500 gm/mole). The specifics of these variations are not important to this invention. However, as will be understood by one of ordinary skill in the art, it is important to determine the value of $POPI_o$.

Determining Value of Standard—$POPI_o$

The value of $POPI_o$ can be determined from rock samples from an oil-filled reservoir, similar to the drilling target, that are of good reservoir quality, or from a sample of oil that is similar to the expected composition of the well's targeted zone. In the case where similar rock samples are used, steps a–c as previously described are employed to determine the value of $POPI_o$. Where an oil sample is used to determine $POPI_o$, the following procedure is followed:

1) To 1 cc of the oil sample, add 9 cc of a suitable solvent, such as methylene chloride, dimethyl sulfide or other suitable solvent that will completely dissolve the oil sample and that is readily evaporated at 60° C. Characteristics of solvents?]
2) Prepare 9 steel crucibles with approximately 100 mg of clear silica gel.
3) Apply to the silica gel, using an accurate syringe, three samples each of the solution of the oil in solvent in quantities of 10, 20, and 30 micro-liters.
4) Dry the samples at 60° C. in a vacuum oven for 4 hours.
5) Subject the samples to pyrolytic analysis, using 100 milligrams as the required input sample size for the instrument, to provide data corresponding to LV, TD, and TC.
6) Utilize standard spreadsheet and graphics software to input the data and prepare a plot with the y-parameter being the POPI value and the x-parameter being the sum of total hydrocarbons (LV+TD+TC).
7) Select the range for the value of $POPI_o$ from the chart where the value of total hydrocarbons is between 4–6 milligrams per gram of sample.

This value is a fairly typical value of the residual staining that remains after sample preparation from oils that are less than 42 API gravity. Oils of higher API gravity may require the use of lesser values for total hydrocarbons, since the residual hydrocarbon staining may be significantly lower due to evaporation of the light components and lower amounts of the medium and heavy components. Evaluation of good quality and productive reservoir rock is the preferred means of determining the value of $POPI_o$ for reservoirs yielding oil having an API greater than 4Z.

Sample Preparation

In accordance with methods known to the prior art, cutting samples can conveniently be collected from the shale shaker on the drill rig. The wet cuttings are sieved to obtain about 1–2 gms of particles between 40/120 mesh.

In accordance with the method of the invention, the sieved samples are rinsed with water and then with an aqueous solution of hydrochloric acid at a pH of about 5 to remove any water-soluble polymer components carried over from the drilling mud. The washed cuttings are dried in a vacuum oven at about 60° C. (approximately one hour.)

The dry cuttings are ground, e.g., using a mortar and pestle, and can now be processed in the same manner as ground core samples for pyrolytic analysis in any one of the known instruments.

In the interests of reducing the time between sample collection and the generation of the graphic plot, the drying step can be expedited by use of a mechanical shaker or other means that will agitate or tumble the rock fragments comprising the cutting sample and expose the individual surfaces. The ability to rapidly process the samples is a significant factor since under some conditions up to a 100 feet interval can be drilled horizontally during a two-hour test and data processing period.

Using known methods and apparatus the prepared reservoir rock sample is subjected to pyrolytic analysis. The data discussed below were obtained using the instrument sold by IFP under the trademark ROCK-EVAL in combination with a general purpose computer. The computer was programmed (using existing software provided by the manufacturer) to calculate the quantitative values for the hydrocarbons released from the prepared samples corresponding to the values of SI (or vTPH or LV) and $S_2$, which is then reprocessed by the operator to determine the values corresponding to TD and TC. The data values of the consecutive analyses were transferred to a spreadsheet for further manipulation and evaluation.

Having obtained the quantitative values for LV, TD, and TC for a given sample, the method of the invention is used to calculate the following parameter for a sample "X":

$$ln(LV_x+TD_x+TC_x)\times(TD_x+TC_x)=POPI_x \qquad (II)$$

In a preferred embodiment, this data point is entered on a graphical plot of POPI versus the measured depth corresponding to the location of that sample to provide a permanent record. Alternatively, the data can be entered in tabular form, e.g., on a chart. The data can also be stored in the memory device of a preprogrammed general purpose computer for the purpose of generating graphic and/or tabular data outputs after analysis of all samples has been completed.

As will be understood, the process is repeated for cutting samples obtained from adjacent locations. The number of samples collected and analyzed, and their relative proximity, will determine the precision of the data obtained and the eventual graphic plot. A graphic plot of the data points provides a convenient mode for visualizing the regions demarked by the POPI values derived from formula (I).

What we have found is that certain values of the POPI can be used to reliably indicate the condition and quality of reservoir rock. The values are as follows:

A POPI greater than about $POPI_o$, indicates oil-producing reservoir rock;

a POPI between 0 and ½$POPI_o$ indicates tar-occluded or non-reservoir rock; and a POPI between about 1/2 $POPI_o$ and $POPI_o$ indicates marginally oil-producing reservoir rock.

The unique reliability of the POPI is based on the fact that it combines different aspects of pyrolysis output parameters into a single number that has a practical utility in assessing reservoir quality. The first term in the equation, ln(LV+TD+TC), reflects the total quantity of hydrocarbons remaining in a rock sample after the effects of in-reservoir alteration, hydrocarbon flushing by the drilling fluid, evaporation of the light components, and losses due to cleaning and processing the sample, as described above. The second term, TD/TC, reflects the ratio of the quantity of light and heavy components in a sample, or the "quality" of the oil. The proximity of this number to the values of hydrocarbon fluids actually produced indicates whether significant alterations to the composition of the fluid have occurred. Thus, when the POPI method yields values that approximate, or are close to the value of $POPI_o$, it is consistent with: (1) a favorable reservoir quality that reflects the migration of petroleum migration into the rock, and (2) a alteration effects that are generally associated with a variety of reservoir conditions that result in poorer oil productivity.

DETAILED DESCRIPTION OF THE INVENTION

Figure 1:
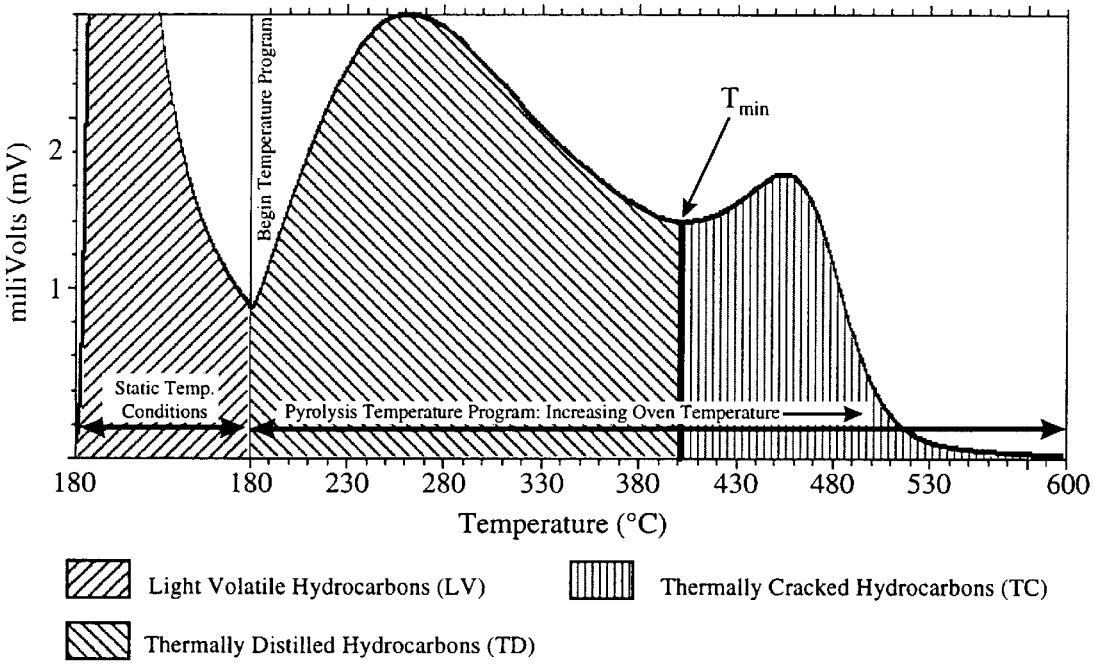
FIG. 1 is the typical instrument output or pyrogram (prior to reprocessing the data) from an oil sample, indicating the areas associated with the data used to calculate the POPI values in accordance with formula (I).

The graphical plot of the typical output pyrogram obtained by employing the Rock-Eval instrumentation in accordance with methods well-known in the prior art is shown in FIG. 1. The curve represents the flame ionization detector's (FID's) response for the initial static temperature conditions and the later temperature-programmed pyrolysis of the sample. The area under the curve represents the relative values or quantities of light volatile hydrocarbons (LV), thermally distilled hydrocarbons (TD) and thermally cracked hydrocarbons (TC), which values are used to calculate to POPI. The value of LV is obtained directly from the instruments sold by Humble and Vinci with no further reprocessing, while the values of TD and TC require additional processing of the initial output data by the operator.

Figure 2:
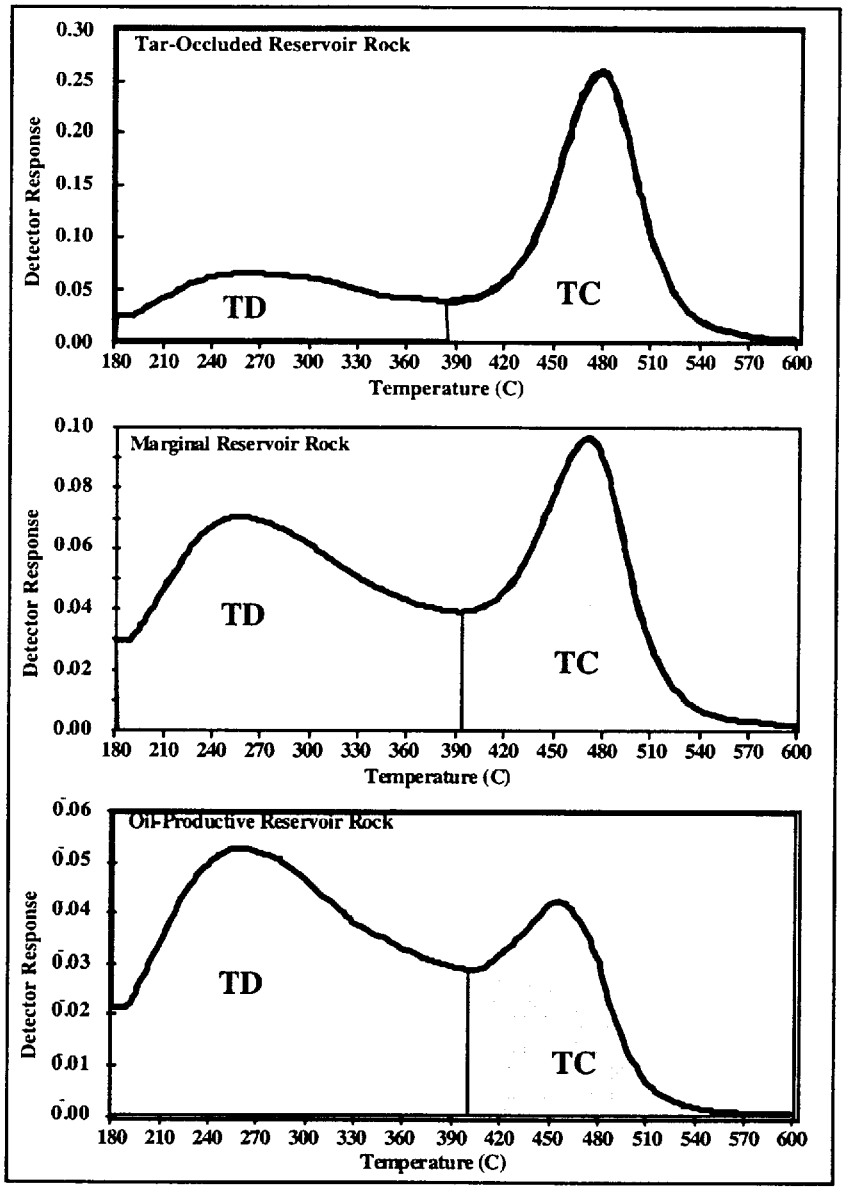
FIGS. 2A 2B and 2C are plots of typical data obtained from the pyrolytic analysis of reservoir rock indicating the regions associated with the values TD and TC for tar-occluded reservoir rock, marginally productive reservoir rock, and oil productive reservoir rock, respectively.

Reprocessed graphic plots of hydrocarbons versus temperature of typical quantitative analyses of rock samples from a well which are indicative of tar-occluded, marginal, and oil-productive reservoir rock are shown in FIGS. 2A–2C. The plots represent straight-forward manipulations of data obtained employing the ROCK-EVAL instrumentation in accordance with methods well-known in the prior art.

As is indicated on the plots, FIG. 2A represents tar-occluded rock, 2B marginally productive reservoir rock and 2C oil productive reservoir rock. In the plots of FIGS. 2A–2C, the TD peak corresponds to the thermovaporization of approximately C18–C40 hydrocarbons present in the reservoir rock sample, and the TC peak mainly corresponds to the thermovaporization and cracking of approximately C40 and greater hydrocarbons, including the cracking of the resins and asphaltenes.

As noted above, the expression Pyrolytic Oil-Productivity Index, or POPI, is determined as follows:

$$POPI=ln(LV+TD+TC)\times(TD\div TC). \quad (I)$$

By employing the values of LV, TD and TC obtained for rock samples from a horizontal well and the equation (I), the graphic plot of FIG. 3A was prepared in accordance with the method of the invention.

In FIGS. 3A and 3B, the abscissa is the measured depth in feet and the ordinate values are various pyrolytic and petrophysical parameters. The plots of FIGS. 3A and 3B provide a comparison of predicted reservoir performance for a horizontal well by petrophysical logs (3B) and the Pyrolytic Oil-Productivity Index (3A). The POPI interpretation identifies the same changes in reservoir quality that are interpreted from the well logs as plotted in FIG. 3B. The minor differences that are present are a thin marginal bed at 8480 ft., a thin tar-occluded bed at 9940 ft., and the shifting of some oil-productive to marginally oil-productive boundaries to deeper apparent depths. These shifted boundaries resulted from the mixing of cuttings and can be prevented by stopping to circulate "bottoms-up" cuttings during drilling operations. The horizontal lines at POPI values of about 1/2 $POPI_o$ and $POPI_o$ demark the following regions: oil-productive rock (above $POPI_o$), marginally oil-productive rock (between about ½$POPI_o$, and $POPI_o$), and tar-occluded and/or non-reservoir rock (between about ½$POPI_o$ and zero.)

Figure 4:
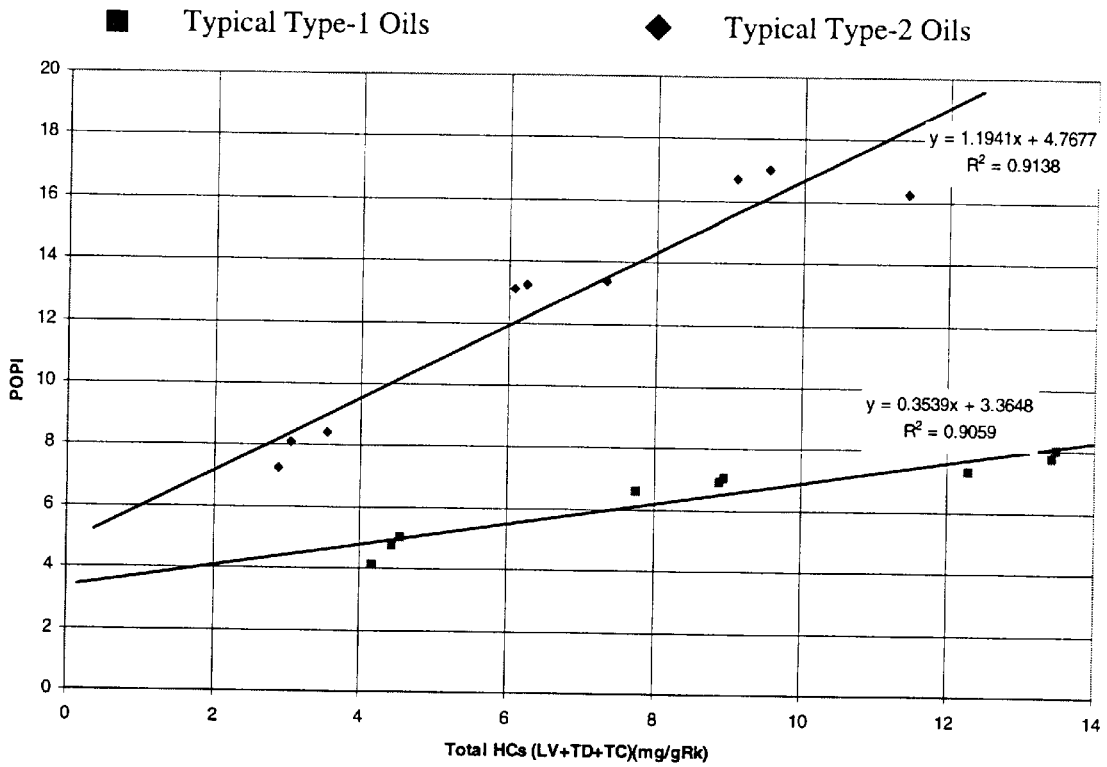
FIG. 4 is a graphic cross-plot of total hydrocarbons (LV+TD+TC) versus the Pyrolytic Oil-Productivity Index (POPI) used to determine the value of $POPI_o$.

The value of $POPI_o$ can be obtained by subjecting an oil of a composition that is similar to the expected oil in the reservoir to the procedure set forth in steps 1–7 of the method as described above. FIG. 4 is a cross-plot of the POPI and total hydrocarbons showing the separate trends that are characteristic three typical oils of two distinct different oil-types. From these data, the $POPI_o$ (the POPI that is expected for a sample from a typical good quality oil reservoir with a given oil type) can be estimated as the value of POPI that corresponds to a total hydrocarbon yield of around 4–6 mg/g of rock.

Again, with reference to FIGS. 3A and 3B, the reliability of the results of the pyrolytic analysis method of the invention is confirmed by comparison with petrophysical data for the same region. The data were obtained and analyzed for Region "A" in drilling a horizontal oil well which penetrated partially occluded/partially productive and oil-productive portions of a tar mat. The results from Region "A" confirm the strong correspondence between the pyrolytic and petrophysical data. From 8,460 ft. to 8,970 ft., the formation was dominated by a completely tar-occluded region and some marginal regions, as is evident from the combination of high porosity (Phi), high total HCs (LV+TD+TC), and correspondingly low TD/TC, Phi*Sxo, and POPI plots. While the lower porosity areas do contain tar, they are not completely occluded because the low porosity inhibits filling the pore space. Both the TD/TC and POPI plots differentiate the oil-productive and the tar-occluded/non-reservoir portions of the formation.

The POPI method is also utilized to effectively differentiate between oil-productive and marginal reservoir quality. For example, the marginal reservoir quality zone from 9,775 to 9,925 ft. is distinguished from oil-productive reservoir by the POPI but not by the TD/TC ratio. Note that the reservoir quality boundaries are displaced to greater depths in this area. This shifting is due to drilling ahead and not stopping periodically to circulate "bottoms-up." The POPI also does a better job of identifying non-reservoir rock that is tight but contains staining of normal hydrocarbons. This is evident in the low porosity zone form 9,200 to 9,500 ft., where the TD/TC ratio indicates marginal quality reservoir, but the POPI clearly identifies this region as non-reservoir rock. Also, Phi*Sxo can be especially misleading in lower permeable reservoir rock. This is caused by inefficient mud-cake formation in the well bore. Because mud-cake does not form as quickly over lower permeability rock, the mud filtrate water can invade the formation over a much longer time period, and thus, invade farther. This produces an exaggerated assessment of the moveability of hydrocarbons (as is seen in the intervals from ~8,600 ft to 8,700 ft., ~8,875 to 8,925, and from ~9,075 ft. to 9,200 ft (FIG. 3) that is overcome by the POPI method.

Figure 3:
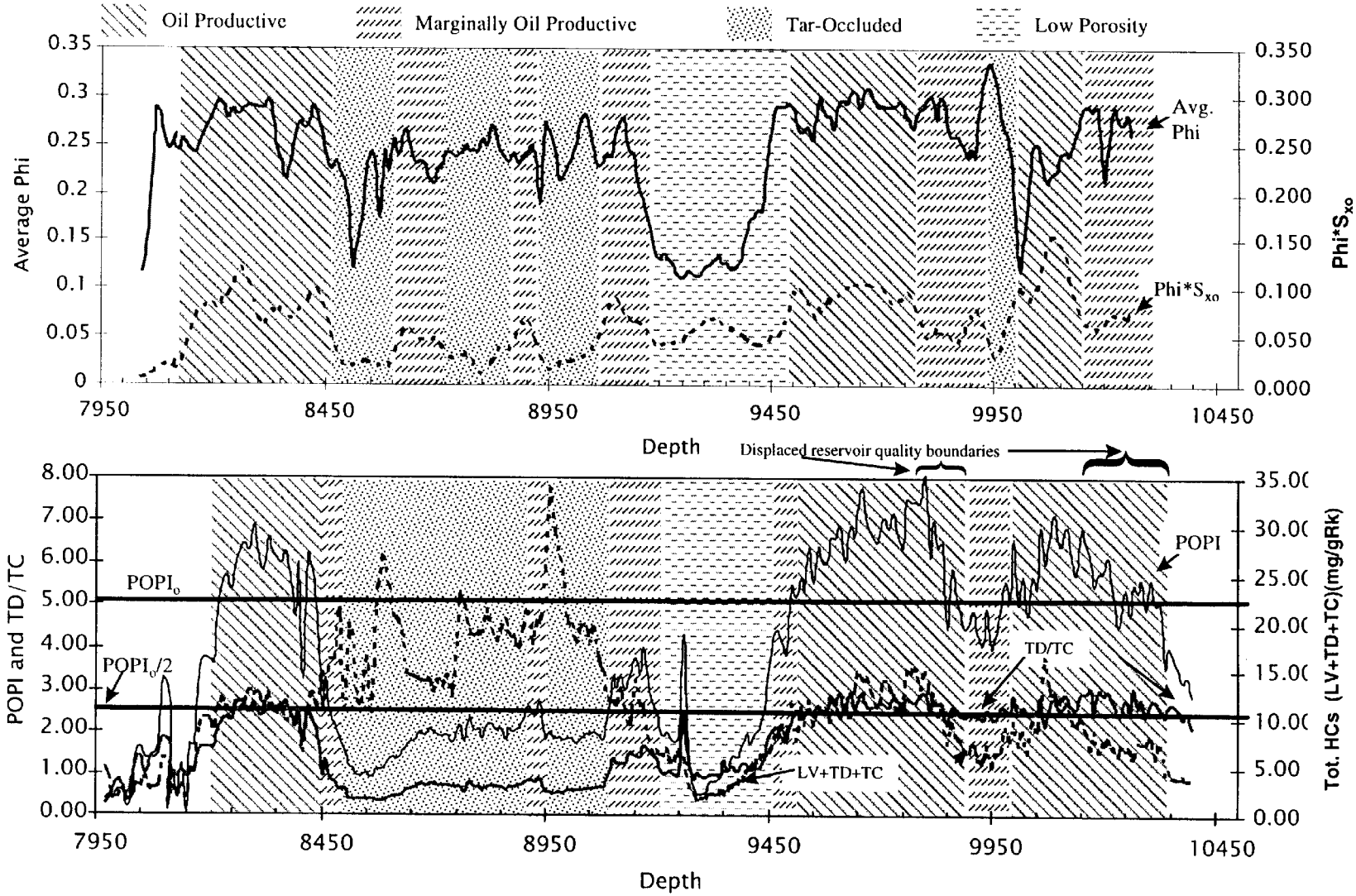
FIG. 3 is a comparative graphic plot of data obtained by the method of the present invention and petrophysical log data obtained by prior art methods with interpreted zones indicated for the quality of the reservoir rock.
Figure 5:
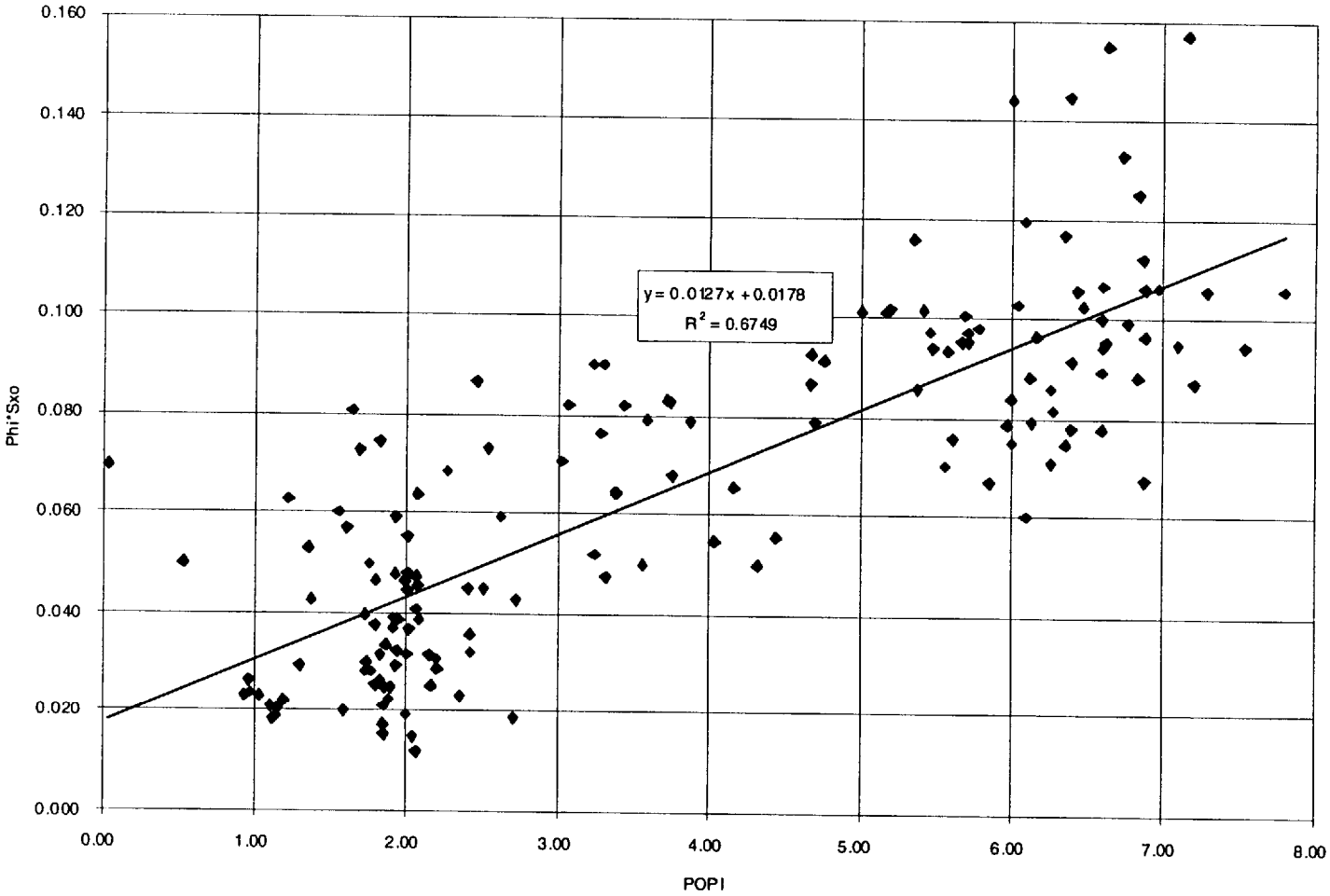
FIG. 5 is a cross-plot of Phi*Sxo versus POPI for data obtained from the well in the example shown in FIG. 4.

The general correspondence between the reservoir quality as determined by the POPI and prior at methods from FIG. 3, is shown in FIG. 5 by plotting Phi*Sxo versus POPI. While there is some scatter in the data, this is typical of the scatter found when employing cross-plot graphics with petrophysical data. The importance of this general relationship is that relative differences seen in the POPI have significance in determining reservoir performance.

Figure 6:
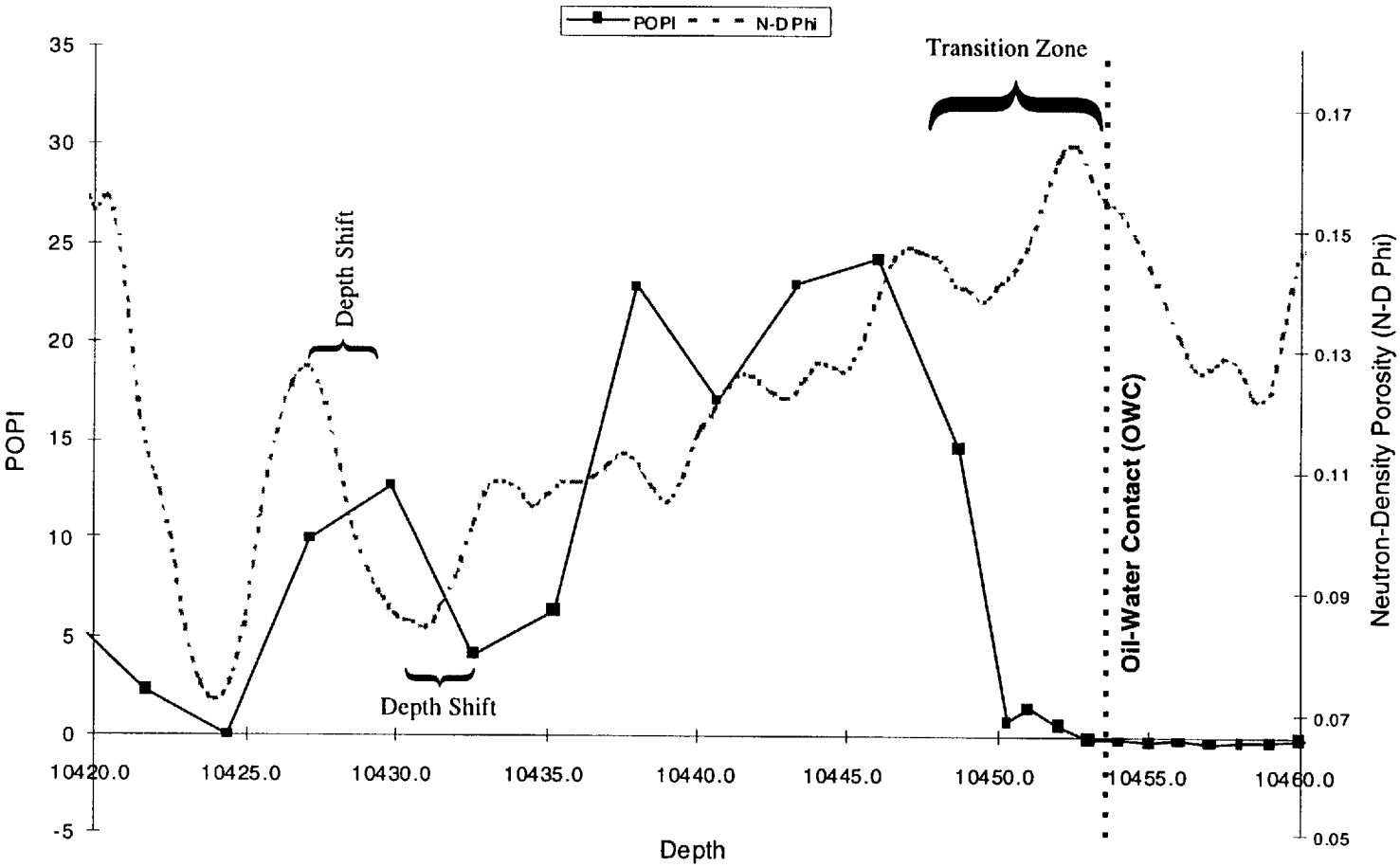
FIG. 6 is a comparative graphic plot of POPI and neutron-density cross-plot porosity (N-D Phi) versus depth for a well exhibiting both gas-oil and oil-water contacts.

Moreover, a detailed analysis of productive formation elsewhere shows that the POPI can also be used to differentiate between good and excellent reservoirs. FIG. 6 is a plot of measured depth versus neutron density cross-plot porosity, (N-D Phi), and POPI, in which the reservoir was characterized based on the combination of the pyrolytic and petrophysical data. The trend in increasing POPI from approximately 10,433 ft. to 10,447 ft. corresponds to porosity that increases from about 8% to 14%.

An increase of 6% in porosity corresponds to a substantial improvement in reservoir performance, establishing that the POPI method has potential for assessing differences between good and excellent reservoirs prior to running well logs.

Figure 7:
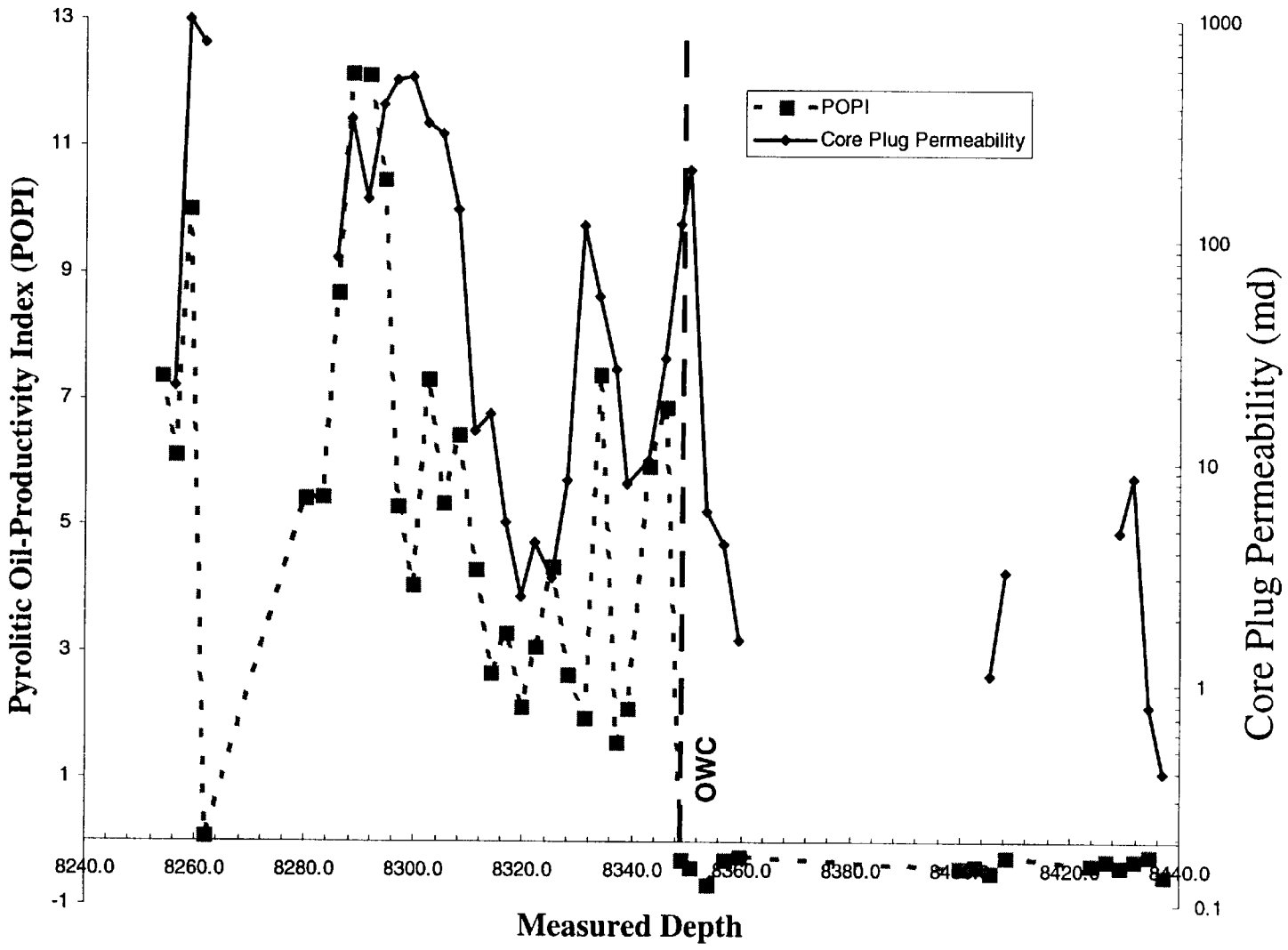
FIG. 7 is a comparative graphic plot of POPI and core plug permeability versus depth.

The same correspondence between the POPI and reservoir performance is observed when comparing it to core plug permeability. FIG. 7 shows that variations in the POPI and core plug permeability mirror each other and that the highest values of POPI correspond to permeability over 100 millidarcys ("md") and lowest values correspond to permeability less than 10 md. Thus, by a variety of different petrophysical measurements, the POPI yields the same interpretation of reservoir performance, but in a timely and cost efficient manner not previously available to the art. Using the method of the invention to optimize the value of the POPI during horizontal drilling greatly increases the likelihood of staying within the most productive portion of the reservoir. The use of the method leads to greater productivity for individual wells by substantially increasing the length of the well path in that part of the reservoir exhibiting optimum conditions.

Figure 8:
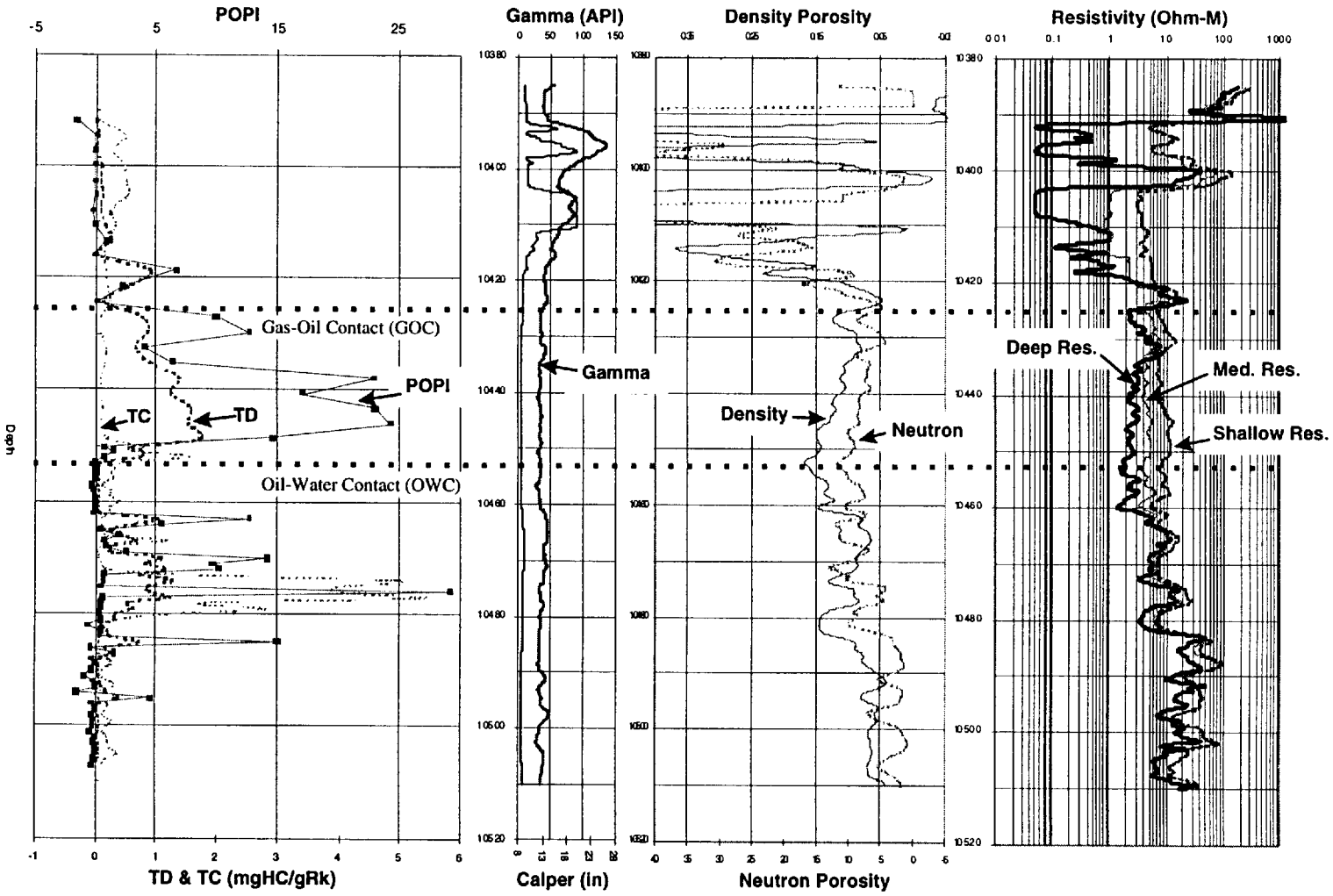
FIG. 8 is a comparative graphic plot of depth profiles for pyrolytic data and petrophysical log data obtained by prior art methods for a well exhibiting both gas-oil and oil-water contacts.

FIG. 8 is a comparison of POPI, TD, and TC depth profiles to standard petrophysical data for a well with gas-oil and oil-water contacts. In this plot, the OWC as interpreted from well logs has been obscured by a dramatic change in the formation's water salinity from below the oil column, This has been caused by a later incursion (post oil migration) of fresh meteoric ground water that has been well documented by laboratory analyses from wells in the area. The problem of predicting the type of formation fluids (oil or water) in this geographical area of operations is common.

FIGS. 7 and 8 also demonstrate how the data can be used to determine when the drill-bit has moved downward structurally through an oil-water contact (OWC). When this situation occurs, the value for POPI becomes negative. This transition can reliably be interpreted where at least poor quality oil-productive reservoir is present. A gas-oil contact (GOC) can also be interpreted in a similar manner, except that the change is from low positive or negative numbers to values that are indicative of oil-productivity as one moves downward through the reservoir. These are interpretations that can routinely be made, even by well-site geologists with limited experience. In these cases, the examination of drill cutting samples would assist in confirming that major lithologic changes were not responsible for differences in the POPI.

The plot of FIG. 8 shows how the POPI can yield a more accurate interpretation of the oil-productive reservoir than the petrophysical tools. With respect to the particular site, it was well known that ground water flow through oil-productive reservoirs had occurred over the last 50,000 years. This relatively fresh water had displaced the original, relatively salty, low resistivity water that was present during marine deposition of the sandstone reservoirs. These historical events obscured the resistivity response to the OWC and now show no discernible difference in the invasion profile above and below the OWC. (Invasion profile refers to the separation of the data curves from the shallow, medium, and deep radius of investigation resistivity tools and is more obvious between 10,420 and 10,462 ft.). In this case, the use of expensive logging-while-drilling ("LWD") tools would not have correctly interpreted the lack of oil productivity between 10,450 and 10,462 ft.

The close relationship between the petrophysical and POPI data plots confirms the validity of the use of the method of the invention in predicting reservoir performance, particularly where tar mats and reservoir fluid contacts are encountered. Furthermore, the ability to effectively differentiate more subtle changes in reservoir performance from the POPI data has been established empirically. The method of the invention can be used more cost-effectively than prior methods and data as a basis for directing the forward movement of the drill bit during continuing horizontal drilling operations. Analytical utilization of all of the data generated from the POPI method can be used to delineate not only tar-occluded and non-tar-occluded sections, but also to indicate low porosity or low effective porosity zones.

More importantly, the method of the invention also differentiates between good and excellent reservoir rock. These distinctions are important indicators of changes in stratigraphic conditions within a reservoir and can be used to maintain the position of the drill bit in the "sweet spot" of the target reservoir.

The limitations of prior art methods in assessing the effects of the invasion of mud filtrate in low permeability zones are overcome by the POPI method of the invention. In cases where the low permeability is due to a generally lower porosity zone, the poorer reservoir is evident from lower total hydrocarbon value for LV+TD+TC and yields a lower POPI value. In the case of lower permeability due to substantial tar occlusion, the TD/TC ratio lowers the POPI value. Conversely, the interpretation of a lower POPI value can be made more conclusive by referring to the values of the POPI component variables: low total hydrocarbons (LV+TD+TC) point to lower porosity or effective porosity in the reservoir, while low TD/TC ratios indicate tar occlusion or other oil degradation processes.

From the standpoint of operations, the method of the invention can be practiced on site at the location of the drilling rig. This is an important factor in minimizing the turn-around time from collection of cutting samples to generation and interpretation of the data from the pyrolytic analysis of those samples. An average turn-around time of two hours for continuous operations has been achieved using standard equipment. A reduction in sample preparation time, as by the use of specialized vacuum dryers, can lead to further substantial reductions in the turn-around time. This makes the method of the invention an invaluable tool for predicting reservoir performance when the data are needed, that is, while the well is still being drilled.

A factor that can affect the accuracy of the method of the invention for predicting the quality and condition of the reservoir rock at a specified depth is a caving or sloughing of the drill cuttings. The effect of cavings on POPI is the apparent shifting of some boundaries of reservoir performance deeper in the well as seen in FIG. 3. In analyzing the data, it will be understood that a change in reservoir character from oil-productive to tar-occluded/non-reservoir quality may be partially masked by cavings until representative cuttings are collected for an interval, either by stopping to circulate "bottoms up" when an important change in reservoir character is detected, or by drilling ahead until a sufficient thickness of similar quality reservoir has been drilled to result in a more homogenous sample. The second practice is discouraged because it decreases the value of the information that is obtained prior to getting representative cuttings, thereby, decreasing the resolution of the data.

In any event, the art has developed methods for determining the extent and effect of cavings on depth calculations and these techniques can be used to correct data entries associated with apparent measured depth plots or tables in practicing the present invention.

As noted above, the values for the LV, TD, and TC parameters were determined on pyrolytic instrumentation known as Rock-Eval®. Data obtained from different instrumentation may not be identical. This is because the furnace geometry, design of the heating mechanism and the efficiency of heat transfer, and crucible geometry all play a role in quantifying the LV, TD, and TC parameters. However, the fundamental relationship on which the POPI method is based remains valid. Since the POPI may be somewhat different for the same sample if different pyrolysis instrumentation is used, the limits for characterizing the reservoir rock may vary. The methodology described above will enable one of ordinary skill in the art to determine the equivalent parameters without departing from the scope and spirit of the invention.

There are a variety of ways in which the teachings and spirit of this invention may be practiced which include the steps of sample preparation, instrument input parameters, and the way that the output data are reported. For example, an experienced worker in the field of the present art, could select different temperature cut-off values, that in turn could be used to develop new indices that combine components that relate to the quantity and nature of the hydrocarbons present in rock samples. Such variations in methodology will be understood to fall within the scope of the present invention and, in fact, might be necessary for the application of the technique to specific field conditions.

We claim:

1. An improved method employing data derived from the pyrolytic analysis of reservoir rock from an oil field for predicting the oil-production characteristics of said reservoir rock within the range of oil-productive rock, marginally oil-productive rock and tar-occluded or non-reservoir rock, which method comprises the steps of:

(a) collecting a sample of rock from a known depth and location in the field;

(b) preparing said sample for pyrolytic analysis;

(c) obtaining the values for LV, TD, and TC resulting from the pyrolytic analysis of said prepared sample;

(d) calculating the value of the pyrolytic oil productivity index, POPI, for the sample in accordance with the following equation:

$$POPI\ ln(LV+TD+TC)\times(TI)\text{--}TC);$$

where n is a natural logarithm, LV is the weight in milligrams of hydrocarbon released per gram of rock at the static temperature condition of 180 degrees Celsius prior to the programmed pyrolysis of the sample, TD is the weight in milligrams of hydrocarbon released per gram of rock at a temperature between 180 degrees Celsius and $T_{min}$ degrees Celsius, TC is the weight in milligrams of hydrocarbon released per gram of rock at a temperature between $T_{min}$ degrees Celsius and 600 degrees Celsius, and $T_{min}$ represents the total weight of hydrocarbons released in that temperature range;

(e) recording the value of POPI and the measured depth for the sample;

(f) collecting a sample of rock from a different location and at a known measured depth in the field;

(g) repeating steps (b)–(f) for a plurality of known sampling locations;

(h) calculating the value of $POPI_o$ for a representative sample of crude oil of the type found in good quality reservoir rock in the oil field; and (i) identifying depths corresponding to POPI values of (i) from 0 to about ½$POPI_o$ as tar-occluded or nonreservoir rock, or both;

(ii) from about ½$POPI_o$, to $POPI_o$, as marginally oil-productive reservoir rock; and (iii) above about 5.0 as oil-productive reservoir rock.

2. The method of claim 1 where the values of POPI and the measured depth for each sample are recorded on a graph.

3. The method of claim 1 where the values of POPI and the measured depth for each sample are recorded in tabular form.

4. The method of claim 2 where the depth is recorded along the abscissa of the graph.

5. The method of claim 1 where the values obtained from the pyrolytic analysis are fed to a pre-programmed general purpose computer.

6. The method of claim 2 where the graphical plot is generated by a pre-programmed general purpose computer.

7. The method of claim 1 where the samples are rock cuttings produced by a drill bit.

8. The method of claim 7 in which the rock samples are collected from an active drilling site.

9. The method of claim 1 where the sample in step (h) is obtained from a drilling core.

10. A method for obtaining data derived from the pyrolytic analysis of a sample "A" of reservoir rock collected from a pre-determined position in a reservoir region in order to characterize the reservoir performance as an oil-productive region or a tar-occluded region, the pyrolytic analysis data being the values for $LV_{1A}$, $TD_{1A}$ and $TC_{1A}$ for the sample, the method comprising the steps of:

(a) calculating the value of $POPI_o$ for a representative sample of crude oil of the type found in good quality reservoir rock in the oil field;

(b) recording the location in the reservoir from which the sample A was obtained;

(c) obtaining the values for $LV_{1A}$, $TD_{1A}$, and $TC_{1A}$ resulting from the pyrolytic analysis of said prepared sample A;

(d) calculating the value of the pyrolytic oil productivity index, $POPI_A$, for the sample in the equation $$POPI_A = ln(LV_{1A}+TD_{1A}+TC_{1A})\times(TD_{1A}\div TC_{1A}); \quad (I)$$

(e) recording the information obtained from either or both of steps (b) and (d), above, for the sample A;

(f) comparing the value of $POPI_A$ calculated for the sample A to the table of $POPI_o$ standards, where $POPI_A > POPI_o$ indicates oil-productive rock, $POPI_A < ½POPI_o$ indicates tar-occluded or non-reservoir rock, and $½POPI_o \geqq POPI_A \leqq POPI_o$ indicates marginally productive reservoir rock.

11. The method of claim 10 where the sample A is a rock cutting produced by a drill bit.

12. The method of claim 10 where the sample A is removed from a drilling core.

13. The method of claim 10 where the pyrolytic analysis is conducted on a rock sample obtained from an active drilling site.

14. The method of claim 10 where the information is recorded in tabular form.

15. The method of claim 10 where the information is recorded in graphical form.

16. The method of claim 10 where the information is recorded in a memory device of a pre-programmed general purpose computer.

17. The method of claim 13 where the direction of drilling is changed based on the information obtained in step (f).

18. The method of claim 10 where steps (b) through (f) are repeated for a plurality of samples from different positions in the reservoir rock.

19. The method of claim 10 where the information from steps (b) and (d) for a plurality of samples is recorded graphically.

20. A method for directing a drill bit of a well-drilling rig during the drilling of a horizontal well to locate the advancing bit in an oil-productive stratum of reservoir rock, the method comprising the steps of:

(a) calculating the value of $POPI_o$ for a representative sample of crude oil of the type found in good quality reservoir rock in the oil field;

(b) collecting a first sample "A" of rock from a measured known depth A and location in the field;

(c) preparing said sample A for pyrolytic analysis;

(d) obtaining the values for $LV_A$, $TD_A$ and $TC_A$ resulting from the pyrolytic analysis of said prepared sample;

(e) calculating the value of the pyrolytic oil productivity index, $POPI_A$, for the sample in accordance with the following equation $POPI_A=\ln(LV_A+TD_A+TC_A)\times(TD_A\div TC_A)$;

(f) horizontally advancing the drill bit if the value of $POPI_A$ is greater than or equal to $POPI_o$ (g) collecting subsequent samples of rock at depth A and repeating steps (b) through (e), above;

(h) vertically displacing the advancing bit to a different known depth B if the value of $POPI_A$ for a subsequent sample is less than $\frac{1}{2}POPI_o$;

(i) repeating steps (a)–(g) above until a value of $POPI_B$ for a sample B is $\frac{1}{2}POPI_o$ or greater;

(j) advancing the bit at about the same vertical depth from the position at which the sample B producing a $POPI_B$ value of $\frac{1}{2}POPI_o$ or greater was taken; and (k) repeating steps (a) through (i), above.

21. The method of claim 20 where the value of POPI for a sample B in step (i) is about equal to the value of $POPI_o$.

22. A method for directing a drill bit of a well drilling rig during the drilling of a horizontal well to maintain the advancing bit in an oil productive stratum of reservoir rock, the method comprising the steps of:

(a) calculating the value of $POPI_o$ for a representative sample of crude oil of the type found in good quality reservoir rock in the oil field;

(b) collecting a sample A of rock from a measured known depth A and location in the field;

(c) preparing said sample A for pyrolytic analysis;

(d) obtaining the values for $LV_A$, $TD_A$ and $TC_A$ resulting from the pyrolytic analysis of said prepared sample A;

(e) calculating the value of the pyrolytic oil-productivity index, $POPI_A$, for the sample A in accordance with the following equation $$POPI_A=ln(LV_A+TD_A+TC_A)\times(TD_A\div TC_A);$$

(f) advancing the bit at about the same vertical depth if the value of $POPI_A$ is greater than $\frac{1}{2}POPI_o$;

(g) collecting subsequent samples of rock at depth A and repeating steps (a) through (e), above;

(h) repeating the steps (a)–(e) above until a value of the $POPI_B$ for a sample is less than $\frac{1}{2}POPI_o$;

(i) vertically displacing the advancing bit to a different known depth B;

(j) repeating steps (a)–(h) above until a value of the $POPI_B$ for the sample B is $\frac{1}{2}POPI_o$ or greater;

(k) advancing the bit at a vertical depth that is about the same as that from which the sample producing a $POPI_B$ value of $\frac{1}{2}POPI_o$ or greater was taken; and (l) repeating steps (a) through (j), above.

23. The method of claim 22 which includes the further step of vertically displacing the advancing bit to a different known depth A until a value of the $POPI_X$ for a sample X is about equal to, or is greater than the value of $POPI_o$.

* * * * *